US006652728B1

(12) United States Patent
Sonntag et al.

(10) Patent No.: US 6,652,728 B1
(45) Date of Patent: Nov. 25, 2003

(54) CYANIDE-FREE AQUEOUS ALKALINE BATH USED FOR THE GALVANIC APPLICATION OF ZINC OR ZINC-ALLOY COATINGS

(75) Inventors: Birgit Sonntag, Berlin (DE); Udo Grieser, Berlin (DE); Barrie Sydney James, Rugby (GB)

(73) Assignee: Atotech Deutschland GmbH, Berlin (DE)

( * ) Notice: Subject to any disclaimer, the term of this patent is extended or adjusted under 35 U.S.C. 154(b) by 0 days.

(21) Appl. No.: 09/786,242

(22) PCT Filed: Jul. 26, 1999

(86) PCT No.: PCT/EP99/05318

§ 371 (c)(1),
(2), (4) Date: Jun. 25, 2001

(87) PCT Pub. No.: WO00/14305

PCT Pub. Date: Mar. 16, 2000

(30) Foreign Application Priority Data

Sep. 2, 1998 (DE) ..... 198 40 019

(51) Int. Cl.[7] ..... C25D 3/22; C25D 3/56

(52) U.S. Cl. ..... 205/143; 205/244; 205/245; 205/246; 205/309; 205/310

(58) Field of Search ..... 205/143, 244, 205/245, 246, 309, 310; 106/129

(56) References Cited

U.S. PATENT DOCUMENTS 3,884,774 A 5/1975 Kessler (List continued on next page.)

FOREIGN PATENT DOCUMENTS

DE 25 25 264 12/1976

(List continued on next page.)

*Primary Examiner*—Roy King
*Assistant Examiner*—William T. Leader
(74) *Attorney, Agent, or Firm*—Workman Nydegger

(57) ABSTRACT

An aqueous alkaline cyanide-free bath for the galvanic deposition of zinc or zinc alloy coatings on substrate surfaces is described, which contains in addition to a source of zinc ions and optionally a source of further metal ions, also hydroxide ions and a polymer of the general formula A that is soluble in the bath

A as well as optionally conventional additives. The bath may furthermore contain a quaternary derivative of a pyridine-3-carboxylic acid of the formula B and/or a quaternary derivative of a pyridine-3-carboxylic acid of the formula C

B

C

A process for the galvanic deposition of zinc coatings and zinc alloy coatings using the aforedescribed bath is also described.

By using the baths according to the invention it is possible to produce coatings that exhibit a uniform layer thickness combined with a high gloss, and which do not exhibit any tendency to exfoliate.

30 Claims, 1 Drawing Sheet

U.S. PATENT DOCUMENTS

| | | | | | |
|---|---|---|---|---|---|
| 4,030,987 | A | | 6/1977 | Fujita et al. | |
| 4,717,458 | A | * | 1/1988 | Martin et al. | 205/246 |
| 4,889,602 | A | * | 12/1989 | Oshima et al. | 205/176 |
| 5,405,523 | A | | 4/1995 | Eckles | |
| 5,435,898 | A | | 7/1995 | Commander et al. | |

FOREIGN PATENT DOCUMENTS

| | | |
|---|---|---|
| DE | 40 38 721 | 6/1992 |
| DE | 195 09 713 | 3/1995 |
| EP | 0 037 634 | 10/1981 |
| JP | 4-198160 | 7/1992 |

* cited by examiner

FIG
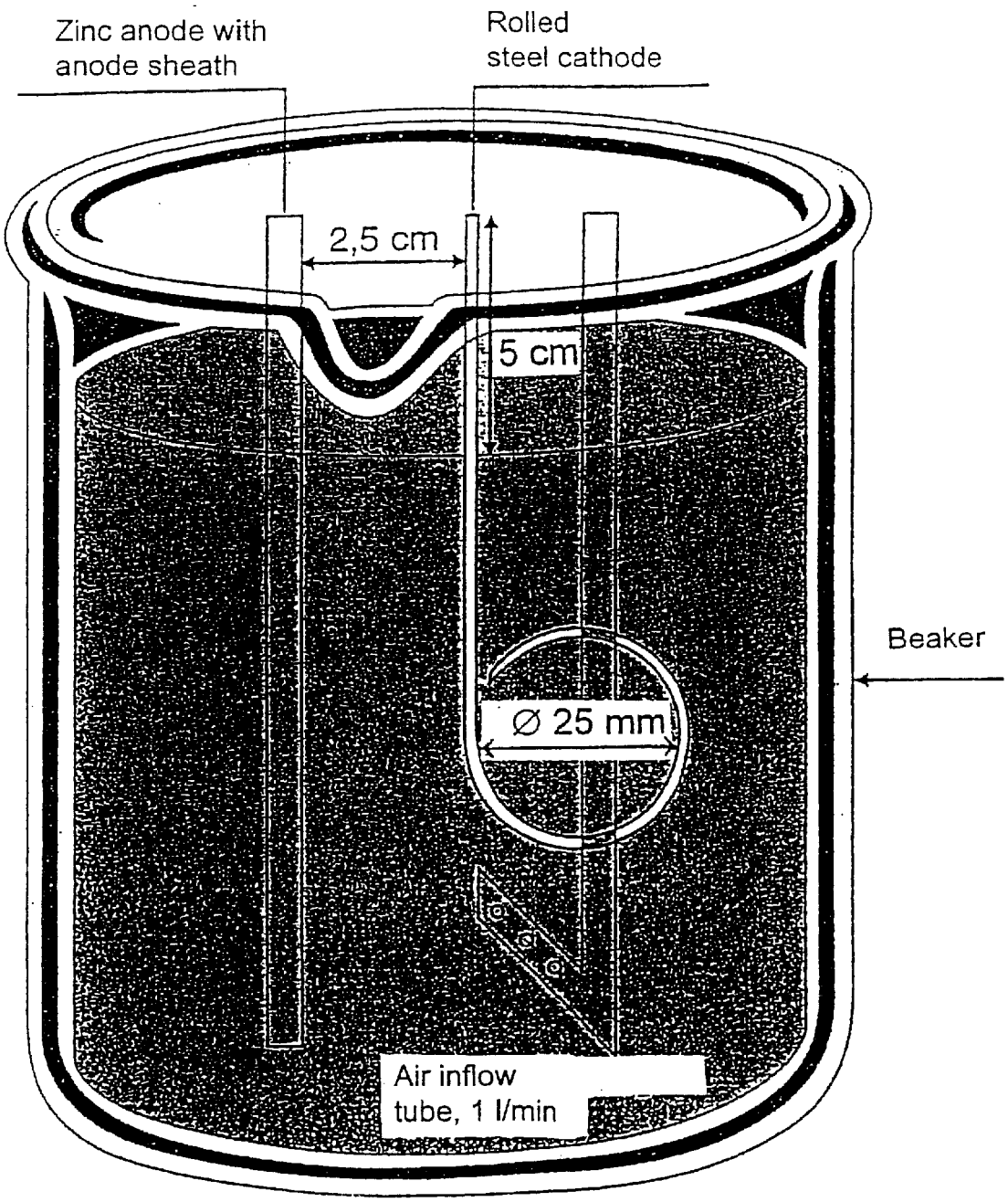

CYANIDE-FREE AQUEOUS ALKALINE BATH USED FOR THE GALVANIC APPLICATION OF ZINC OR ZINC-ALLOY COATINGS

BACKGROUND OF THE INVENTION

1. Field of the Invention

The present invention relates to aqueous alkaline cyanide-free baths for the galvanic deposition of zinc or zinc alloy coatings on a substrate.

2. The Relevant Technology

The deposition of zinc from cyanide, alkaline solution has dominated the industrial market for many years. The ever-increasing demands on electrodeposition plants as regards the disposal of old zinc electrolyte baths and the associated stringent controls on the effluent have led to an increased interest in the non-toxic, cyanide-free zinc electrolyte baths. Cyanide-free zinc electrolyte baths can be subdivided into two types of baths, namely weakly acidic zinc electrolytes (containing zinc chloride and/or zinc sulfate) and alkaline zincate electrolytes.

A uniformly lustrous zinc layer is deposited from weakly alkaline zinc baths, with the result that this method has rapidly captured a large part of the market. This method has the disadvantage however that its current yield is always 100% over a broad current density range.

In the case of coating pieces that have a simple shape, this may be regarded as a positive feature since the current is consumed exclusively in the deposition of zinc. However, in the case of coating parts that have a complicated shape, this leads to a thick zinc layer in the region of high current densities, and to very thin zinc layers in the region of low current densities.

The ratio of zinc layer thickness in the high current density range to the zinc layer thickness in the low current density range is termed the layer thickness distribution and in the ideal case should be 1. Zinc and zinc alloy baths always have to satisfy relatively high demands. Accordingly, a zinc layer on the object to be coated should have the same layer thickness everywhere and should exhibit a high gloss. A good layer thickness distribution can be achieved by reducing the current yield in the high current density range, while the current yield in the low current density range remains the same.

This manner of adjustment of the zinc layer thickness over a broad current density range has hitherto been successfully achieved only by the deposition of zinc from alkaline, cyanide-free electrolytes. Alkaline zinc galvanizing baths are generally based on an aqueous solution of zincate ions in sodium or potassium hydroxide. By using these baths it is possible to deposit zinc layers having a high gloss (DE 25 25 264, U.S. Pat. No. 3,884,774), although these zinc layers do not have a uniform layer thickness distribution.

Numerous proposals for improving the layer thickness distribution of the zinc layers by adding suitable additives have already been made in the prior art (U.S. Pat. Nos. 5,405,523, 5,435,898, DE 195 09 713, U.S. Pat. No. 4,030,987).

With the hitherto proposed additives there is however the disadvantage that the galvanically produced zinc layers have a tendency to undergo exfoliation. The exfoliation of zinc and/or zinc alloy layers from the coated substrate, often also termed "blistering", constitutes a serious problem when using cyanide-free, alkaline baths, and in this connection there is still no reliable information as regards the influence of the additives used in each case on the blistering. The phenomenon of blistering is particularly disadvantageous since it often occurs only after several weeks and may therefore frequently lead to claims and litigation in the coating industry.

U.S. Pat. No. 5,405,523 describes as additive in zinc alloy baths a substance with the trade name Mirapol A 15 and similar compounds, which is said to improve the gloss of zinc alloys.

U.S. Pat. No. 5,435,898 describes as additive for zinc and zinc alloy galvanizing baths a similar compound having the trade name Mirapol WT, which likewise is said greatly to improve the layer thickness distribution.

DE 195 09 713 describes a diallyl ammonium/sulfur dioxide copolymer as additive for zinc and zinc alloy galvanizing baths, which is said to impart a uniform layer thickness to the zinc layer.

U.S. Pat. No. 4,030,987 similarly describes a diallyl ammonium/sulfur dioxide copolymer as additive for zinc and zinc alloy galvanizing baths, which is said to impart a uniform layer thickness to the zinc layer.

It has been found however that the aforedescribed additives have disadvantages in the deposition of the zinc layer, and in particular lead to blistering of the coatings.

BRIEF SUMMARY OF THE INVENTION

The object of the present invention is accordingly to overcome the defects of the prior art and in particular to provide an aqueous cyanide-free alkaline bath for the galvanic deposition of zinc and zinc alloy coatings, by means of which coatings of zinc or zinc alloys can be obtained in which there is no tendency to undergo exfoliation even after prolonged storage. In this connection the advantages of these baths as regards a uniform layer thickness, a high gloss, and the uniformity of the alloy components in the coating should be retained over a broad range of current densities.

BRIEF DESCRIPTION OF THE DRAWINGS

The FIGURE is a perspective view of a beaker in which the inventive bath is disposed for the application of a zinc or zinc alloy coating on a substrate.

DETAILED DESCRIPTION OF THE PREFERRED EMBODIMENT

It has now been found that the addition of a special type of quaternary ammonium polymers to aqueous alkaline cyanide-free zinc baths improves the layer thickness distribution of the resultant coatings and reduces blistering of the said coatings.

The present invention accordingly provides an aqueous alkaline cyanide-free bath for the galvanic deposition of zinc or zinc alloy coatings on substrate surfaces, which is characterised in that the bath contains (a) a source of zinc ions and optionally a source of further metal ions, (b) hydroxide ions, and (c) a polymer soluble in the bath and having the general formula A

A

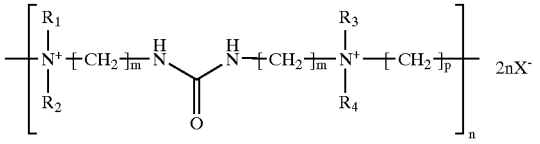

wherein m has the value 2 or 3, n has a value of at least 2, $R_1$, $R_2$, $R_3$ and $R_4$, which may be the same or different, each independently denote methyl, ethyl or hydroxyethyl, p has a value in the range from 3 to 12, and $X^-$ denotes $Cl^-$, $Br^-$ and/or $I^-$, as well as optionally (d) conventional additives.

The soluble polymer of the general formula A that is contained in the bath according to the invention may be obtained by reacting N,N'-bis[3-(dialkylamino)alkyl]ureas with 1,ω-dihalogen alkanes. This reaction can be represented by the following reaction scheme, the radicals $R_1$–$R_4$, X as well as m and n being as defined above:

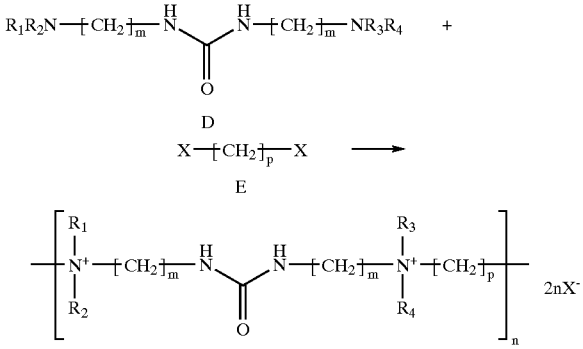

The reaction of the starting products may be carried out for example in aqueous solution and at temperatures in the range from 20 to 1000° C. The polymers of the formula A that are used according to the invention may be obtained in this way, the aminourea units of the polymers being connected by hydrocarbon bridges. The degree of polymerisation of these polymers is 2–80. The starting substances of the general formulae D and E are known per se. The diaminoureas of the formula D are described for example in JP 04-198160.

The further starting products for the production of the polymers used according to the invention are 1,ω-dihalogen alkanes of the general formula E. Individual examples of these 1,ω-dihalogen alkanes are 1,3-dichloropropane, 1,4-dichlorobutane, 1,5-dichloropentane and 1,6-dichlorohexane.

The polymer of the formula A is contained in the bath according to the invention in an amount of 0.1 to 50 g/l, preferably 0.25 to 10 g/l. The degree of polymerisation of the polymer A does not play any role in avoiding blistering and improving the layer thickness distribution; the necessary solubility of the polymer in the galvanic bath simply sets an upper limit on the degree of polymerisation.

According to a preferred embodiment of the invention the bath contains as further additive a quaternary derivative of a pyridine-3-carboxylic acid of the formula B and/or a quaternary derivative of a pyridine-3-carboxylic acid of the formula C

B

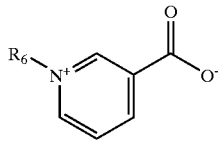

C

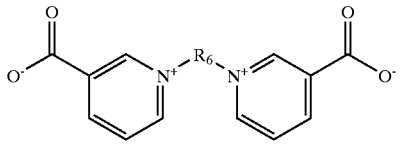

wherein $R_6$ denotes a saturated or unsaturated, aliphatic, aromatic or araliphatic hydrocarbon radical with 1 to 12 carbon atoms.

The amount of this additional additive in the bath according to the invention is 0.005 to 0.5 g/l, preferably 0.01 to 0.2 g/l.

The quaternary derivatives of a pyridine-3-carboxylic acid of the formula B or C that are used as further additives in the bath according to the invention are compounds known per se and are described for example in B. S. James, M. Phil. thesis, Aston Univ. 1979 or DE 40 38 721. These derivatives are generally prepared by reacting nicotinic acid with aliphatic, aromatic or araliphatic halogenated hydrocarbons.

The addition of the further additive B and/or C produces a further improvement in the layer thickness distribution. The improvement in the gloss may be mentioned as a further advantage of the addition of the aforementioned derivatives B and C to the bath according to the invention.

Finally, the baths according to the invention may additionally contain, besides the aforementioned additives A, B and/or C, also further polymers such as for example the polymers named in the aforementioned printed specifications.

Apart from the addition, according to the invention, of the polymer of the general formula A as well as optionally the quaternary derivative of a pyridine-3-carboxylic acid of the formula B and/or C, the cyanide-free zinc baths according to the invention correspond to the conventional aqueous alkaline cyanide-free electrolyte baths such as are used for the deposition of zinc or zinc alloy coatings on various substrates. Standard baths of this type are described for example in DE 25 25 264 and U.S. Pat. No. 3,884,774.

Thus, the baths according to the invention contain the conventional sources of zinc ions, such as for example zinc metal, zinc salts and zinc oxide, in which connection however zinc oxide is preferred and is present as zincate in alkaline solution.

The concentration of the zinc in the baths according to the invention is in the range usual for such baths, i.e. from 0.2 to 20 g/l, preferably 5 to 20 g/l.

If coatings of zinc alloys are to be deposited from the baths according to the invention, these baths contain a source of further metal ions. Such metal ions are preferably ions of cobalt, nickel, manganese and/or iron. Salts of the corresponding metals, preferably of the aforementioned metals, optionally also as a mixture, are preferably used as sources of these additional metal ions.

Individual examples of suitable salts are nickel sulfate, iron sulfate, cobalt sulfate and manganese chloride.

The concentration of the metal ions in the baths according to the invention may vary within a wide range and is preferably 0.01 to 100 g/l. Since with different types of alloys a different proportion of alloy is also necessary in order for example to improve the corrosion protection, this concentration is different from metal ion to metal ion. The baths preferably contain zinc in an amount of 0.2 to 20 g/l, cobalt in an amount of 10 to 120 mg/l, nickel in an amount of 0.3 to 3 g/l, manganese in an amount of 10 to 100 g/l and iron in an amount of 10 to 120 mg/l. These concentrations refer to the amount of metal ions contained in the bath. The amounts of the salts of these metals to be used in each case are determined by appropriate calculation.

If the baths according to the invention contain the aforementioned additional metal ions, it is expedient to add to the baths also complex-forming agents adapted to these additional metal ions in order to control the deposition potentials and permit a common reduction with the zinc ions that are present.

Chelate-forming agents are preferred as such complex-forming agents. Examples of suitable chelate-forming agents include hydroxycarboxylates such as sodium gluconate, aminoalcohols such as triethanolamine, polyamines such as polyethylenediamine, aminocarboxylates such as EDTA, aminophosphonates such as aminotris (methylenephosphonic acid), and polyhydric alcohols such as sorbitol or sucrose. The chelate-forming agent may be contained individually or as a mixture in the baths according to the invention, the amount of the agent preferably being in the range from 2 to 200 g/l.

The baths according to the invention contain—like the corresponding baths of the prior art—a source of hydroxide ions, preferably an alkali hydroxide. Sodium hydroxide is usually used, in a concentration of 80 to 250 g/l; however, other alkali and alkaline earth metal hydroxides as well as mixtures thereof are suitable for use in the bath according to the invention. An improvement in the gloss of the zinc layer is achieved by using for example potassium hydroxide.

The baths according to the invention may furthermore contain known levelling agents such as 3-mercapto-1,2,4-triazole and/or thiourea, the latter being preferred. The concentration of the levelling agent is the normal concentration for use in zinc baths, and ranges for example from 0.01 to 0.50 g/l. Further additives for the baths according to the invention include aromatic aldehydes or their bisulfite adducts.

Preferred aromatic aldehydes are selected from the group comprising 4-hydroxybenzaldehyde, 4-hydroxy-3-methoxybenzaldehyde (vanillin), 3,4-dimethoxybenzaldehyde, 3,4-methylenedioxybenzaldehyde, 2-hydroxybenzaldehyde and 4-hydroxybenzaldehyde, or mixtures thereof. These additives, whose concentration is in the range from 0.005 to 1.0 g/l preferably from 0.01 to 0.50 g/l, act in a manner known per se as brightening agents. A particularly preferred example of such a brightening agent is vanillin. In addition the bath according to the invention may also contain other substances as brightening agents, such as for example substances selected from the group comprising sulfur compounds, aldehydes, ketones, amines, polyvinyl alcohol, polyvinyl pyrrolidone, proteins or reaction products of halogenated hydrines with aliphatic or aromatic amines, polyamines or heterocyclic nitrogen compounds, and mixtures thereof.

Finally, the baths according to the invention may also contain water-softener, since the sensitivity of the bath according to the invention to foreign metal ions, in particular calcium and magnesium ions from tap water, is reduced by the use of such additives. Examples of such water-softener are EDTA, sodium silicates and tartaric acid.

By using the baths according to the invention normal electrically conducting substrates of metal may be provided with a coating of zinc or of a zinc alloy.

The present invention accordingly also provides a process for the galvanic deposition of zinc coatings or zinc alloy coatings on conventional substrates, which is characterised in that a bath having the above composition is used as galvanizing bath. In the process according to the invention the deposition of the coatings is preferably carried out at a current density in the range from 0.01 to 10 A/dm$^2$, as well as at a temperature in the range from 15 to 45° C.

The process according to the invention may for example be carried out as a drum galvanizing process when used for mass parts, and as a frame galvanizing process for deposition on larger workpieces. In this connection anodes are used that may be soluble, such as for example zinc anodes, which at the same time serve as a source of zinc ions so that the zinc deposited on the cathode is recovered by dissolution of zinc at the anode. Alternatively insoluble anodes such as for example iron anodes may also be used, wherein the zinc ions removed from the electrolyte have to be replenished in another way, for example by using a zinc dissolving tank.

As is usual in galvanic deposition, the process according to the invention may also be operated with air injection and with or without movement of the articles being coated, without having any deleterious effects on the resultant coatings.

The invention is illustrated and described in the following examples.

1. Test Process Employed in the Examples 1.1 Quick Test of Blistering for Evaluating the Polymeric Additives Used According to the Invention In order to observe the phenomenon of blistering, a quick test was developed by the applicants that is able to reproduce in the laboratory the phenomena that occur during production. This test was accordingly chosen so as to combine all the properties that lead to blistering. These include in particular coating under compressive stress, under powerful air injection, at room temperature, in the presence of substances promoting blistering, and at high layer thicknesses. The phenomenon of blistering within a few hours after coating in such electrolytes containing additives that have a tendency to cause blistering has been successfully reproduced.

An apparatus according to the accompanying FIGURE as well as the following basic electrolyte were used in the quick test of blistering:

10 g/l Zn 130 g/l NaOH 20 g/l $Na_2CO_3$ 1.2 g/l of diallyl ammonium/sulfur dioxide copolymer (DE 195 09 713, U.S. Pat. No. 4,030,987)

0.19 g/l of the reaction product of epichlorohydrin with dimethylaminopropylamine (U.S. Pat. No. 3,884,774)

9.2 mg/l of N-benzylpyridinium-3-carboxylate 1.25 g/l of Trilon D (trisodium salt of hydroxyethylethylenediamine triacetic acid; BASF, 40% solution)

0.1 g/l of 3-mercaptotriazole 900 ml of the solution are added to a wide 1 l capacity beaker (see FIG.). A coated Zn anode serves as anode. The test is carried out under a powerful air injection (1 l/min) that flows out from a L-shaped plastics tube having 6 small holes (3 on each side) arranged underneath the cathode. The cathode sheet (18.5 cm×5 cm) is bent at the lower end and coated for 35 minutes at 2.8 A. The bath should have a temperature of 20° C., since blisters form especially at low temperatures. The cathode sheet is rinsed, brightened for 10 sec. in 0.3 vol % of $HNO_3$, rinsed once more, and dried under compressed air. The sheet is then carefully straightened out until it is fully flat, and is then kept at room temperature. The sheet must be inspected daily for blistering.

1.2 Layer Thickness Distribution Test

The following basic electrolyte is used:

10 g/l Zn 130 g/l NaOH 20 g/l $Na_2CO_3$ 250 ml of the solution are added to a Hull cell. A Zn anode serves as anode. The cathode sheet is coated for 15 minutes at 1 A. The bath should have a temperature of 28° C. The sheet is rinsed, brightened for 10 sec. in 0.3 vol % of $HNO_3$, rinsed once more, and dried under compressed air. The layer thickness measurement is made at two points 3 cm from the lower edge and 2.5 cm from the right-hand and left-hand edges at high current density (2.8 A/dm$^2$) and low current density (0.5 A/dm$^2$). XRF measurements are made at four points at the relevant position in order to keep measurement errors as small as possible. The layer thickness distribution corresponds to the ratio of the measured values for the layer thickness at high current density (hcd) and low current density (lcd).

Layer thickness distribution=hcd:lcd

2. Examples of Preparation of the Polymers Used According to the Invention 2.1 Preparation of a Polymer in which $R_1$, $R_2$, $R_3$, $R_4$=methyl; m=3; p=4

20.0 g (86.8 mmole) of N,N'-bis[3-(dimethylamino) propyl]urea are dissolved in 200 ml of water. 11.13 g (86.8 mmole) of 1,4-dichlorobutane are then added. The mixture is then heated for 8 hours at 80° C. while stirring. An aqueous polymer solution is obtained after cooling.

2.2 Preparation of a Polymer in which $R_1$, $R_2$, $R_3$, $R_4$=methyl; m=3; p=3

10.0 g (43.4 mmole) of N,N'-bis[3-(dimethylamino) propyl]urea are dissolved in 100 ml of water. 4.95 g (43.4 mmole) of 1,3-dichloropropane are then added. The mixture is then heated for 7 hours at 90° C. while stirring. An aqueous polymer solution is obtained after cooling.

2.3 Preparation of a Polymer in which $R_1$, $R_2$, $R_3$, $R_4$=methyl; m=3; p=6

20.0 g (86.8 mmole) of N,N'-bis[3-(dimethylamino) propyl]urea and 13.46 g (86.6 mmole) of 1,6-dichlorohexane are heated in 50 ml of water for 17 hours at 80° C. An aqueous polymer solution is obtained after cooling.

2.4 Preparation of a Polymer in which $R_1$, $R_2$, $R_3$, $R_4$=methyl; m=3; p=5

20.0 g (86.8 mmole) of N,N'-bis[3-(dimethylamino) propyl]urea are dissolved in 200 ml of water. 12.36 g (86.8 mmole) of 1,5-dichloropentane are then added. The mixture is now heated for 17 hours at 80° C. while stirring. An aqueous polymer solution is obtained after cooling.

2.5 Preparation of a Polymer in which $R_1$, $R_2$, $R_3$, $R_4$=ethyl; m=3; p=3

5.00 g (17.3 mmole) of N,N'-bis[3-(diethylamino)propyl] urea are dissolved in 10 ml of water. 1.95 g (17.3 mmole) of 1,3-dichloropropane are then added. The mixture is now heated for 16 hours at 100° C. while stirring. An aqueous polymer solution is obtained after cooling.

2.6 Preparation of a Polymer in which $R_1$, $R_2$, $R_3$, $R_4$=methyl; m=2; p=3

5.00 g (24.7 mmole) of N,N'-bis[2-(dimethylamino)ethyl] urea are dissolved in 10 ml of water. 2.79 g (24.7 mmole) of 1,3-dichloropropane are then added. The mixture is now heated for 24 hours at 90° C. while stirring. An aqueous polymer solution is obtained after cooling.

3. Example of the Preparation of the Quaternary Derivative of pyridine-3-carboxylic Acid Synthesis of N,N'-p-xylylene-bis-[pyridinium-3-carboxylate) (formula C, $R_6$=p-xylylene)

5.00 g (39.80 mmole) of nicotinic acid are added to 20 ml of n-butanol at room temperature, following which 5.41 g (19.90 mmole) of α,α'-dibromo-p-xylene are added at room temperature. The mixture is then heated for 16 hours at 70° C. and the precipitated product is filtered off, washed with 10 ml of n-butanol and dried. 9.85 g of white crystals are obtained, which melt at 220° C. with decomposition.

4. Examples of Use

EXAMPLES 1–6

A bath having the following composition is used in each case:

10 g/l Zn 130 g/l NaOH 20 g/l $Na_2CO_3$ 1 g/l of additive according to preparation examples 2.1–2.6 (calculated as solid substance)

250 ml of the solution are added to a Hull cell. A Zn anode serves as anode. The cathode sheet is coated for 15 minutes at 1 A. The bath should have a temperature of 28° C. The sheet is rinsed, brightened for 10 sec. in 0.3 vol % of $HNO_3$, rinsed once more, and dried under compressed air. The layer thickness measurement was made at two points 3 cm from the lower edge and 2.5 cm from the right-hand and left-hand edges at high current density (2.8 A/dm$^2$) and low current density (0.5 A/dm$^2$). XRF measurements are made at four points at the respective position in order to keep measurement errors as small as possible. The layer thickness distribution corresponds to the ratio of the measured values for the layer thickness at high current density (hcd) and low current density (lcd).

Layer thickness distribution=hcd:lcd

The results obtained are summarised in the following Table 1:

TABLE 1

| Polymer Used | Layer Thickness hcd | Layer Thickness lcd | Layer Thickness Distribution |
|---|---|---|---|
| $R_1$, $R_2$, $R_3$, $R_4$ = methyl; m = 3; p = 4 | 6.11 μm | 5.38 μm | 1.14 |
| $R_1$, $R_2$, $R_3$, $R_4$ = methyl; m = 3; p = 3 | 6.19 μm | 4.15 μm | 1.49 |
| $R_1$, $R_2$, $R_3$, $R_4$ = methyl; m = 3; p = 6 | 4.71 μm | 3.50 μm | 1.35 |
| $R_1$, $R_2$, $R_3$, $R_4$ = methyl; m = 3; p = 5 | 5.02 μm | 4.03 μm | 1.25 |
| $R_1$, $R_2$, $R_3$, $R_4$ = ethyl; m = 3; p = 3 | 0.76 μm | 0.55 μm | 1.37 |
| $R_1$, $R_2$, $R_3$, $R_4$ = methyl; m = 2; p = 3 | 7.70 μm | 3.53 μm | 2.18 |

EXAMPLES 7–12

A bath having the following composition is used:

10 g/l Zn 130 g/l NaOH 20 g/l $Na_2CO_3$ 1.2 g/l of diallyl ammonium/sulfur dioxide copolymer (DE 195 09 713, U.S. Pat. No. 4,030,987)

0.19 g/l of the reaction product of epichlorohydrin with dimethylaminopropylamine (U.S. Pat. No. 3,884,774)

9.2 mg/l of N-benzylpyridinium-3-carboxylate 1.25 g/l of Trilon D (trisodium salt of hydroxyethylethylenediamine triacetic acid; BASF, 40% solution)

0.1 g/l of 3-mercaptotriazole 1 g/l of additive according to preparation examples 2.1–2.6 (calculated as solid substance)

900 ml of the solution are added to a wide 1 l capacity beaker (see FIG.). A coated Zn anode serves as anode. The test is carried out under a powerful injection of air (1 l/min) that flows out from a L-shaped plastics tube having 6 small holes (3 on each side) arranged underneath the cathode that is used. The cathode sheet (18.5 cm×5 cm) is bent at the lower end and coated for 35 minutes at 2.8 A. The bath should have a temperature of 20° C., since blisters form particularly at low temperatures. The sheet is rinsed, brightened for 10 sec. in 0.3 vol % of $HNO_3$, rinsed once more, and dried under compressed air. The sheet is then carefully straightened out until it is flat, and is then kept at room temperature. The sheet must be inspected daily for blistering.

The results obtained are summarised in Table 2:

TABLE 2

| Polymer Used | Blistering |
|---|---|
| $R_1$, $R_2$, $R_3$, $R_4$ = methyl; m = 3; p = 4 | None |
| $R_1$, $R_2$, $R_3$, $R_4$ = methyl; m = 3; p = 3 | None |
| $R_1$, $R_2$, $R_3$, $R_4$ = methyl; m = 3; p = 6 | None |
| $R_1$, $R_2$, $R_3$, $R_4$ = methyl; m = 3; p = 5 | None |
| $R_1$, $R_2$, $R_3$, $R_4$ = ethyl; m = 3; p = 4 | None |
| $R_1$, $R_2$, $R_3$, $R_4$ = methyl; m = 2; p = 3 | None |

EXAMPLE 13:

An aqueous electrolyte that is suitable for the galvanic deposition of a zinc layer was prepared. The electrolyte had the following composition:

10 g/l ZnO 120 g/l KOH 1 g/l of the additive according to preparation example 2.1 (calculated as solid substance)

20 mg/l of N-benzylpyridinium-3-carboxylate 60 mg/l of thiourea 40 mg/l of anisaldehyde (active substance as bisulfite adduct)

A steel sheet (5 cm×5 cm) was coated for 30 minutes at 2 A/dm$^2$ and at 30° C.

The steel sheet was rinsed and chromated in a commercial blue chromating solution (Corrotriblue, Atotech). The chromated sheet was of commercial standard. The zinc layer did not exhibit any tendency to blistering, and even tempering in a circulating air cabinet for 30 minutes at 220° C. followed by quenching in tap water at room temperature did not lead to exfoliation.

EXAMPLE 14

An aqueous electrolyte suitable for the galvanic deposition of a zinc layer was prepared. The electrolyte had the following composition:

12.5 g/l ZnO 130 g/l NaOH 20 g/l $Na_2CO_3$ 2 g/l of the additive according to preparation example 2.2 (calculated as solid substance)

25 mg/l of N-benzylpyridinium-3-carboxylate 100 mg/l of 3-mercaptotriazole 50 mg/l of p-hydroxybenzaldehyde (active substance as bisulfite adduct)

A Hull cell sheet was coated at 1 ampere and at room temperature for 15 minutes.

The Hull cell sheet was rinsed and chromated in a commercial yellow chromating solution (Tridur Gelb Liquid, Atotech). The chromated sheet exhibited a slight iridescence and was of commercial standard.

The layer thickness distribution was measured according to the aforedescribed test and was 1.30.

The zinc sheet did not display any signs of blistering, even after 30 minutes' tempering in a circulating air cabinet at 220° C. followed by quenching in tap water at room temperature.

EXAMPLE 15

An aqueous electrolyte suitable for the galvanic deposition of a zinc layer was prepared. The electrolyte had the following composition:

18.5 g/l ZnO 115 g/l NaOH 1.5 g/l of the additive according to preparation example 2.5 (calculated as solid substance)

25 mg/l of N,N'-p-xylylene-bis-(pyridinium-3-carboxylate)

70 mg/l of thiourea 60 mg/l of vanillin (active substance as bisulfite adduct)

Steel bolts were galvanized in a drum at a current density of 0.1–1 A/dm$^2$ and at room temperature.

The bolts were then rinsed and chromated in a commercial yellow chromating solution (Tridur Gelb Liquid, Atotech). The chromated bolts were of commercial standard.

The shiny zinc layer was distributed very uniformly on the bolts and did not exhibit any tendency to blistering, even when tempered for 30 minutes at 220° C. in a drying cabinet followed by quenching in water at room temperature.

EXAMPLE 16

An aqueous electrolyte suitable for the galvanic deposition of a zinc-nickel layer was prepared. The electrolyte had the following composition:

10 g/l ZnO 8 g/l $NiSO_4$ 6 $H_2O$ 120 g/l NaOH 30 g/l of triethanolamine 1.5 g/l of the additive according to preparation example 2.4 (calculated as solid substance)

50 mg/l of veretrium aldehyde (active substance as bisulfite adduct)

A steel sheet (5 cm×5 cm) was coated for 30 minutes at 3 A/dm$^2$ and at 30° C. A uniform lustrous zinc-nickel layer was deposited.

The zinc-nickel layer did not show any signs of blistering, even after 30 minutes' tempering in a circulating air cabinet at 220° C. followed by quenching in tap water at room temperature.

EXAMPLE 17

An aqueous electrolyte suitable for the galvanic deposition of a zinc-iron layer was prepared. The electrolyte had the following composition:

15 g/l ZnO 120 g/l NaOH 60 mg/l of iron (as $FeSO_4.7\ H_2O$ )

25 g/l of sodium gluconate 2 g/l of the additive according to preparation example 2.2 (calculated as solid substance)

200 mg/l of 3-mercaptotriazole 40 mg/l of heliotropin (active substance as bisulfite adduct)

A Hull cell sheet was coated for 15 minutes at 1 ampere and at room temperature.

The Hull cell sheet was rinsed and then chromated in a commercial black chromating solution for zinc-iron layers (Tridur Schwartz Liquid ZnFe, Atotech). The chromated sheet exhibited a very good black colour.

The layer thickness distribution was measured according to the aforedescribed test, and was 1.50.

The zinc-iron sheet did not show any signs of blistering, even after 30 minutes' tempering in a circulating air cabinet at 220° C. followed by quenching in tap water at room temperature.

EXAMPLE 18

An aqueous electrolyte suitable for the galvanic deposition of a zinc-iron-cobalt layer was prepared. The electrolyte had the following composition:

12.5 g/l ZnO 110 g/l NaOH 30 mg/l of iron (as $FeSO_4.7\ H_2O$)

30 mg/l of cobalt (as $CoSO_4.7\ H_2O$)

25 g/l of sodium gluconate 2 g/l of the additive according to preparation example 2.3 (calculated as solid substance)

100 mg/l of 3-mercaptotriazole 25 mg/l of N-benzylpyridinium-3-carboxylate

A steel sheet (5 cm×5 cm) was coated for 30 minutes at 2 $A/dm^2$ and at room temperature. A uniform lustrous zinc-iron-cobalt layer was deposited.

The zinc-iron-cobalt layer did not exhibit any signs of blistering, even after 30 minutes' tempering in a circulating air cabinet at 220° C. followed by quenching in tap water at room temperature.

EXAMPLE 19

An aqueous electrolyte suitable for the galvanic deposition of a zinc-manganese layer was prepared. The electrolyte had the following composition:

15 g/l ZnO 120 g/l NaOH 40 g/l of $MnCl_2.4\ H_2O$ 40 g/l of sodium gluconate 4 g/l of ascorbic acid 2 g/l of the additive according to preparation example 2.1 (calculated as solid substance)

100 mg/l of 3-mercapto-1,2,4-triazole 20 mg/l of N-benzylpyridinium-3-carboxylate A Hull cell sheet was coated for 15 minutes at 1 ampere and at room temperature. The Hull cell sheet was rinsed and then brightened for 10 sec. in 0.3 vol. % $HNO_3$.

The layer thickness distribution was measured according to the aforedescribed test, and was 1.41.

The manganese incorporation was measured at the same positions by XRF, at which the layer thickness measurement was carried out. At a current density of 2.8 $A/dm^2$ the manganese content was 5.65%; at 0.5 $A/dm^2$ the manganese content was 7.81%.

Comparison Examples 1–4

A bath having the following composition is used:

10 g/l Zn 130 g/l NaOH 20 g/l $Na_2CO_3$ 1 g/l addition of the additives described in the aforementioned printed specifications (calculated as solid substance)

250 ml of the solution are added to a Hull cell. A Zn anode serves as anode. The cathode sheet is coated for 15 minutes at 1 A. The bath should have a temperature of 28° C., The sheet is rinsed, brightened for 10 sec. in 0.3 vol % of $HNO_3$, rinsed once more, and dried under compressed air. The layer thickness measurement was made at two points 3 cm from the lower edge and 2.5 cm from the right-hand and left-hand edges at high current density (2.8 $A/dm^2$) and low current density (0.5 $A/dm^2$). XRF measurements are made at four points at the relevant position in order to keep the measurement errors as small as possible. The layer thickness distribution corresponds to the ratio of the measured values for the layer thickness at high current density (hcd) and low current density (lcd).

Layer thickness distribution=hcd:lcd

The results obtained are summarised in the following Table 3:

TABLE 3

| Polymer Used | Layer Thickness hcd | Layer Thickness lcd | Layer Thickness Distribution |
|---|---|---|---|
| Reaction product of epichlorohydrin with imidazole DE 25 25 264 | 11.0 μm | 3.80 μm | 2.90 |
| Reaction product of epichlorohydrin with dimethylaminopropylamine U.S. Pat. No. 3,884,774 | 8.65 μm | 2.70 μm | 3.20 |
| Mirapol WT U.S. Pat. No. 5,435,898 | 5.89 μm | 4.17 μm | 1.41 |
| Diallyl ammonium/sulfur dioxide copolymer DE 195 09 713 | 7.10 μm | 2.58 μm | 2.75 |

Comparison Examples 5–6

A bath having the following composition is used:

10 g/l Zn 130 g/l NaOH 20 g/l $Na_2CO_3$ 1.2 g/l of diallyl ammonium/sulfur dioxide copolymer (DE 195 09 713, U.S. Pat. No. 4,030,987)

0.19 g/l of the reaction product of epichlorohydrin with dimethylaminopropylamine (U.S. Pat. No. 3,884,774)

9.2 mg/l of N-benzylpyridinium-3-carboxylate 1.25 g/l of Trilon D (BASF, 40% solution)

0.1 g/l of 3-mercaptotriazole 1 g/l addition of the additives described in the aforementioned printed specifications (calculated as solid substance)

900 ml of the solution are added to a wide 1 l capacity beaker (see FIG.). A wrapped Zn anode serves as anode. The process is carried out under a powerful injection of air (1 l/min) that flows out from a L-shaped plastics tube having 6 small holes (3 on each side) arranged underneath the cathode that is used. The cathode sheet (18.5 cm×5 cm) is bent at the lower end and coated for 35 minutes at 2.8 A. The bath should have a temperature of 20° C., since otherwise blistering occurs especially at low temperatures. The sheet is rinsed, brightened for 10 sec. in 0.3 vol % of $HNO_3$, rinsed once more, and dried under compressed air. The sheet is then carefully straightened out until it is flat, and is stored at room temperature. The sheet must be inspected daily for blistering.

The results obtained are summarised in Table 4:

TABLE 4

| Polymer Used | Blistering |
|---|---|
| Mirapol WT<br>U.S. Pat. No. 5,435,898 | Strong blistering within 3 days |
| Diallyl ammonium/sulfur dioxide copolymer<br>DE 195 09 713 | Immediate, very strong blistering |

What is claimed is:

1. Aqueous alkaline cyanide-free bath for the galvanic deposition of zinc or zinc alloy coatings on substrate surfaces, the bath comprising:

(a) a source of zinc ions;

(b) hydroxide ions; and (c) a polymer soluble in the bath and having the general formula A

A

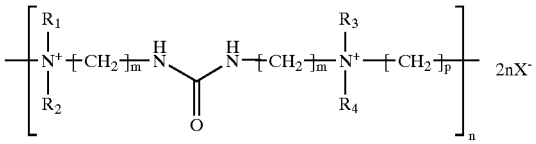

wherein m has a value 2 or 3; n has a value of at least 2; $R_1$, $R_2$, $R_3$ and $R_4$, which may be the same or different, each independently denote methyl, ethyl or hydroxyethyl; p has a value in the range from 3 to 12; and $X^-$ denotes $Cl^-$, $Br^-$ and/or I.

2. Bath according to claim 1, wherein in the general formula A, n has a value in the range from 2 to 80.

3. Bath according to claim 1, wherein the polymer of the formula A, soluble in the bath, is present in an amount of 0.1 to 50 g/l.

4. Bath according to claim 1, further comprising a quaternary derivative of a pyridine-3-carboxylic acid of the formula B and/or a quaternary derivative of a pyridine-3-carboxylic acid of the formula C,

B

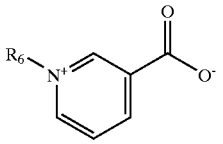

-continued

C

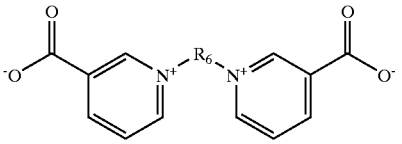

wherein $R_6$ denotes a saturated or unsaturated, aliphatic, aromatic or araliphatic hydrocarbon radical with 1 to 12 carbon atoms.

5. Bath according to claim 4, wherein the quaternary derivative of pyridine-3-carboxylic acid of the formula B and/or C is present in an amount of 0.005 to 0.5 g/l.

6. Bath according to claim 1, wherein the source of zinc ions is zinc oxide.

7. Bath according to claim 1, wherein the concentration of the zinc ions is 0.2 to 20 g/l.

8. Bath according to claim 1, further comprising additional metal ions, the additional metal ions including at least cobalt, nickel, manganese or iron ions.

9. Bath according to claim 8, wherein the zinc is present in an amount of 0.2 to 20 g/l, and the additional metal ions include cobalt in an amount of 10 to 120 mg/l, nickel in an amount of 0.3 to 3 g/l, manganese in an amount of 10 to 100 g/l, and iron in an amount of 10 to 120 mg/l.

10. Bath according to claim 1, wherein the hydroxide ions are formed from sodium hydroxide.

11. Bath according to claim 10, wherein the sodium hydroxide is present in an amount of 80 to 250 g/l.

12. Bath according to claim 1, wherein the hydroxide ions are formed from potassium hydroxide.

13. Bath according to claim 12, wherein the potassium hydroxide is present in an amount of 80 to 250 g/l.

14. Bath according to claim 1, further comprising a brightening agent selected from the group consisting of sulfur compounds; aldehydes; ketones; amines; polyvinyl alcohol; polyvinyl pyrrolidone; proteins; reaction products of halogen hydrines with aliphatic or aromatic amines, polyamines or heterocyclic nitrogen compounds; and mixtures thereof.

15. Bath according to claim 14, further comprising an aromatic aldehyde or a bisulfite adduct thereof.

16. Bath according to claim 15, wherein the aromatic aldehyde is selected from the group consisting of 4-hydroxybenzaldehyde, 4-hydroxy-3-methoxybenzaldehyde, 3,4-dimethoxybenzaldehyde, 3,4-methylenedioxybenzaldehyde, 2-hydroxybenzaldehyde, 4-hydroxybenzaldehyde, and mixtures thereof.

17. Bath according to claim 15, wherein the aromatic aldehyde is present in an amount of 0.005 to 1.0 g/l.

18. Bath according to claim 1, further comprising a complex-forming agent or a water-softener.

19. Bath according to claim 18, wherein the complex-forming agent comprises a chelate-forming agent.

20. Bath according to claim 19, wherein the chelate-forming agent is selected from the group consisting of hydroxycarboxylates, aminoalcohols, polyamines, aminocarboxylates, aminophosphonates, polyhydric alcohols, and mixtures thereof.

21. Bath according to claim 19, wherein the chelate-forming agent is present in an amount of 2 to 200 g/l.

22. Bath according to claim 1, further comprising a sulfur compound as a leveling agent.

23. Bath according to claim 22, wherein the leveling agent comprises at least 3-mercapto-1,2,4-triazole or thiourea.

24. Bath according to claim 22, wherein the sulfur compound is present in an amount of 0.01 to 0.50 g/l.

25. Process for the galvanic deposition of zinc coatings or zinc alloy coatings comprising:

providing a bath according to claim 1; and positioning an electrically conductive substrate within the bath such that a zinc coating or zinc alloy coating is deposited on the substrate.

26. Process according to claim 25, further comprising applying a current density of 0.01 to 10 $A/dm^2$ to the bath.

27. Process according to claim 25, wherein the bath is operated at temperatures from 15 to 45° C.

28. Process according to claim 25, wherein the coating is deposited on the electrically conducting substrate using a drum galvanizing process.

29. Process according to claim 25, wherein the coating is deposited on the electrically conducting substrate using a frame galvanizing process.

30. Process according to claim 25, wherein a coating of a zinc alloy with one or more metals selected from the group consisting of cobalt, nickel, manganese and iron is deposited.

* * * * *

UNITED STATES PATENT AND TRADEMARK OFFICE

CERTIFICATE OF CORRECTION

PATENT NO. : 6,652,728 B1 
DATED : November 25, 2003
INVENTOR(S) : Birgit Sonntag, Udo Grieser and Barrie Sydney James It is certified that error appears in the above-identified patent and that said Letters Patent is hereby corrected as shown below:

Column 3,
Line 45, change "1000º C" to -- 100ºC --

Column 8,
Line 7, change "carboxylate)" to -- carboxylate] --
Line 7, after "p-xylylene)" insert -- : --

Column 12,
Line 16, after "28ºC." delete ","

Signed and Sealed this

Twenty-fourth Day of February, 2004

JON W. DUDAS
*Acting Director of the United States Patent and Trademark Office*